US006733635B1

(12) United States Patent
Ozawa et al.

(10) Patent No.: US 6,733,635 B1
(45) Date of Patent: May 11, 2004

(54) METHOD OF REPAIRING A COKE OVEN BUCKSTAY AND A MOVING DEVICE FOR USE IN SUCH METHOD

(75) Inventors: Tatsuya Ozawa, Chiba (JP); Nozomu Tamura, Chiba (JP); Tetsuro Uchida, Chiba (JP); Nobuya Kamide, Tokyo (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 09/469,819

(22) Filed: Dec. 22, 1999

(30) Foreign Application Priority Data

Jun. 29, 1999 (JP) ..... 11-183105

(51) Int. Cl.[7] ..... B01D 3/00; B01D 3/32

(52) U.S. Cl. ..... 202/239; 52/86; 202/267.1; 202/267.2; 202/270; 202/239; 110/336; 110/337; 110/338; 110/339; 110/340; 110/344; 105/4.1; 105/4.2; 105/4.3; 105/4.4; 105/163.1; 105/163.2; 105/215.2; 105/433

(58) Field of Search ..... 52/86; 702/267.1, 702/267.2, 270, 239; 110/336, 337, 338, 339, 340, 349; 105/4.1, 4.2, 4.3, 4.4, 163.1, 163.2, 215.2, 433

(56) References Cited

U.S. PATENT DOCUMENTS

| | | | | |
|---|---|---|---|---|
| 2,137,763 A | | 11/1938 | Schellentrager | |
| 2,969,884 A | * | 1/1961 | Salmi | 414/586 |
| 5,129,327 A | * | 7/1992 | Snead | 105/4.1 |
| 5,289,780 A | * | 3/1994 | Bounds | 104/242 |
| 6,282,863 B1 | * | 9/2001 | Christian et al. | 52/747.1 |

* cited by examiner

*Primary Examiner*—Glenn Caldarola
*Assistant Examiner*—Alexis Wachtel
(74) *Attorney, Agent, or Firm*—Piper Rudnick LLP

(57) ABSTRACT

A coke oven buckstay moving device and method which can be used to quickly, reliably, and smoothly repair buckstays compared to conventional methods and devices. The coke oven buckstay moving means includes a main car, a subcar, a frame, and securing means. The main car is used when repairing pillered buckstays that support oven walls of the coke oven, and moves on a coke side platform or a machine side platform. The subcar is placed on the main car, and can freely move forward and backward in a direction of a lengthwise direction of the coke oven. The frame is provided in a standing manner on the subcar. The securing members are mounted to the frame and are used to grasp and secure the buckstays. According to the method, a damaged portion of the buckstay is secured to the subcar, cut, and then removed. Reversing the steps, a replacement buckstay is secured to the subcar, moved into position, and welded into place. The subcar is detached, and the oven repaired.

11 Claims, 7 Drawing Sheets

METHOD OF REPAIRING A COKE OVEN BUCKSTAY AND A MOVING DEVICE FOR USE IN SUCH METHOD

BACKGROUND OF THE INVENTION

1. Field of the Invention

The present invention relates to a method of repairing a coke oven buckstay and a moving device for use in such method.

2. Description of the Related Art

The coke oven buckstay is a reinforcing part that supports coke oven walls and that is provided for eliminating the problem of the oven walls breaking or collapsing as a result of expansion of bricks forming the oven walls.

FIG. 1 is a perspective view of what is called a chamber-oven-type coke oven. The coke oven comprises carbonization chambers 52 in which coal is carbonized; combustion chambers 54 in which fuel gas is burned; and a regenerating chamber 59 for pre-heating the fuel gas and combustion air by making use of heat left in the exhaust combustion gas. The carbonization chambers 52 and the combustion chambers 54 are alternately disposed on the top portion of the regenerating chamber 59, forming a group of component parts of the oven. The coal, which has been put into the carbonization chambers 52 by a coal-charging car 51 that moves on the top portion of the coke oven, is carbonized as a result of being subjected to heat from the combustion chambers 54 located on both sides of the carbonization chambers 52 corresponding thereto. Oven doors 58 and 60 are removably disposed on each end of the carbonization chamber. After the oven doors 58 and 60 of the carbonization chamber 52 have been opened, the carbonized coal, that is, coke is pushed out by a pushing ram of pusher machine 55 through a guide car 56, and transported to hot coke quenching facility (not shown) through a coke bucket car 53. Side 3, at which the pusher machine 55 is disposed, is called the machine side (hereinafter referred to as M/S), while side 4, at which the guide car 56 is disposed, is called the coke side (hereinafter referred to as C/S). The directions of a line connecting the M/S and the C/S are called the longitudinal directions of the oven, and the longitudinal directions are represented by a double-headed arrow 61. The directions in which the combustion chambers 54 and the carbonization chambers 52 are arranged are called the widthwise directions, and are represented by a double-headed arrow 62.

FIG. 2 is a sectional view of the coke oven as viewed perpendicular to the longitudinal directions thereof. At the outer sides of the coke oven are disposed M/S and C/S platforms 11*a*, 11*b* along the widthwise directions thereof. These platforms 11*a*, 11*b* are used when, for example, maintaining the oven doors 58 and 60 in an open position. On the top portion of the C/S platform 11*b* are disposed rails 12 on which the guide car moves. Below the M/S platform 11*a* are disposed rails 22 on which the pusher machine moves. As shown in FIG. 2, the coke oven is formed by oven walls 2 formed by placing a plurality of layers of fire-resistant bricks (hereinafter simply referred to as "bricks") upon one another. Pillered steel members or buckstays 5 are disposed vertically in a standing manner at the M/S and the C/S of the oven walls 2 so as to hold and compress them. Tension rods 6 are disposed at the top and the bottom ends of the oven walls 2 disposed at both ends of the coke oven extending in the longitudinal directions thereof. The tension rods 6 are secured to the buckstays 5 with bolts from both ends thereof. The directions in which the securing forces act are represented by arrows 31. Here, the bolts are sometimes secured through springs 7*a* provided at the ends of tension rods 6. (The securing of the bolts is hereunder referred to as "securing of the oven".) Outward deformation of the buckstays 5 may be reduced by pushing in an intermediate portion of the buckstays 5 in a direction opposite the platforms 11*a*, 11*b* by the springs 7*b* from respective frames of the platforms 11*a*, 11*b*.

However, when the coke oven has been in operation for a long time, the C/S buckstay 5*a* may become deformed, as shown in FIG. 3. When this occurs, the coke oven is less properly secured because the bolt-securing forces are not applied to the bricks. The reduced securing forces cause severance and misalignment of the joints between the bricks making up the oven walls. Gaps are produced between the various fittings and the bricks. This results in poor environmental control and undesirable conditions which result, for example, when gas, produced by carbonization of coal, leaks from the gaps between the fittings and the bricks, and black smoke exhausts from a chimney of the coke oven. In addition, increased deformation of the oven body or the buckstay 5*a* results when carbon that has adhered to the severed joints of the bricks grows excessively. To overcome the above-described problems, the operation of the carbonization chamber near the combustion chamber 54 at the location of a considerably deformed part of the coke oven (such as the buckstay 5*a*) is stopped. Other parts may be kept in operation while the damaged parts are replaced. At the same time that the replacement is being carried out, the bricks of the coke oven may be re-stacked.

FIGS. 4A to 4C illustrate a conventional method of repairing the buckstay of the coke oven. The procedure is as follows.

As shown in FIG. 4A, a crane 38 is placed in front of the oven with the combustion chamber 54 at which a considerably deformed part is located. The crane 38 is usually disposed on the ground at a distance of at least ten meters from the oven in a horizontal direction. A boom 35 of the crane 38 is extended to a height that allows the buckstay 5*a* to be suspended. It is usually extended to a height of about 30 meters from the ground. As shown in FIG. 4B, the buckstay 5*a* is supported and secured to a binding jig 36 mounted to an end of the boom 35. At a location 37 that is about 500 mm above the platform 11, the defective portion of the buckstay 5*a* is cut away. Thereafter, as shown in FIG. 4C, the separated portion of the buckstay 5*b* is suspended by the boom 35 that has moved to remove it. After the removal, a new steel member is suspended by the crane and mounted and welded to the remaining undeformed portion of the buckstay in order to affix it thereto.

However, depending on the arrangement of the peripheral facilities of the coke oven, it is probable that a crane may not be disposed in front of the combustion chamber at which the deformed part is located.

Additionally, even when the crane may be disposed so as not to interfere with the peripheral facilities, the boom may not be able to extend to the platform at which the deformed part is located, thus replacing and repairing operations would be prevented. For example, the M/S buckstay 5 of the coke oven shown in FIG. 2 cannot be repaired. This is because, as shown in FIG. 2, collecting main 21, that are provided above each of the buckstays 5 as paths for allowing carbonization gas to flow therethrough, interfere with the boom of the crane.

Repairing operations are usually carried out while most unaffected component parts of the coke oven are in operation. Obviously, the combustion chamber at which the buckstay to be repaired is located and the carbonization chambers near this combustion chamber are taken out of operation during repair. Repairing operations must be carried out quickly to avoid costly down time. However, due to the above-described problems, it takes time to carry out the repairing operations. Therefore, there has been a strong demand for an improved repairing method.

SUMMARY OF THE INVENTION

Accordingly, in view of the above-described problems, it is an object of the present invention to provide a coke oven buckstay repairing method which can be carried out more quickly, reliably, and smoothly than the conventional repairing method; and a moving device used in such method. To achieve this object, the present inventor has assiduously conducted research. Preferred embodiments of the present invention are discussed below.

According to one aspect of the present invention, there is provided a coke oven buckstay moving device for replacing a defective portion of the buckstay, which is supporting a wall of the coke oven, with a replacement member, the moving device comprising: a main car which moves on the coke side platform or the machine side platform of the coke oven; a subcar placed on the main car, freely moving forward and backward in a lengthwise direction of the coke oven; and a securing means, mounted to the subcar, for holding the defective portion of the buckstay or the replacement member.

According to another aspect of the present invention, there is provided a coke oven buckstay repairing method whereby a defective portion of the coke oven buckstay is replaced with a replacement member. The method comprises the steps of: moving a main car that moves on a coke side platform or a machine side platform to an exterior side of the buckstay that needs to be repaired, forwardly moving a subcar disposed on the main car to a location near the buckstay that needs to be repaired, securing the buckstay that needs to be repaired, cutting off and removing the defective portion secured to the subcar, mounting the replacement member of the buckstay to the securing means mounted to the subcar, moving the main car to the previous location of the removed buckstay, forwardly moving the subcar, and mounting and welding the replacement member to the remaining portion of the buckstay at the location where the defective portion has been cut off and removed.

In the present invention, the subcar with securing means for the buckstay is placed on the main car, which can move on either the coke side platform or the machine side platform of the coke oven, so that the subcar can freely move forward and backward in the lengthwise direction of the coke oven. Therefore, the buckstay can be reliably and smoothly secured, removed and replaced, even when, for example, a crane cannot be used to repair the buckstay of the coke oven. Consequently, the deformed portion of the buckstay of the coke oven can be easily and quickly removed by cutting, and replaced with a replacement member in order to repair a buckstay on either the C/S or M/S of the coke oven.

DESCRIPTION OF THE PREFERRED EMBODIMENT

A description will now be given of an embodiment of the present invention with reference to the drawings.

Figure 1:
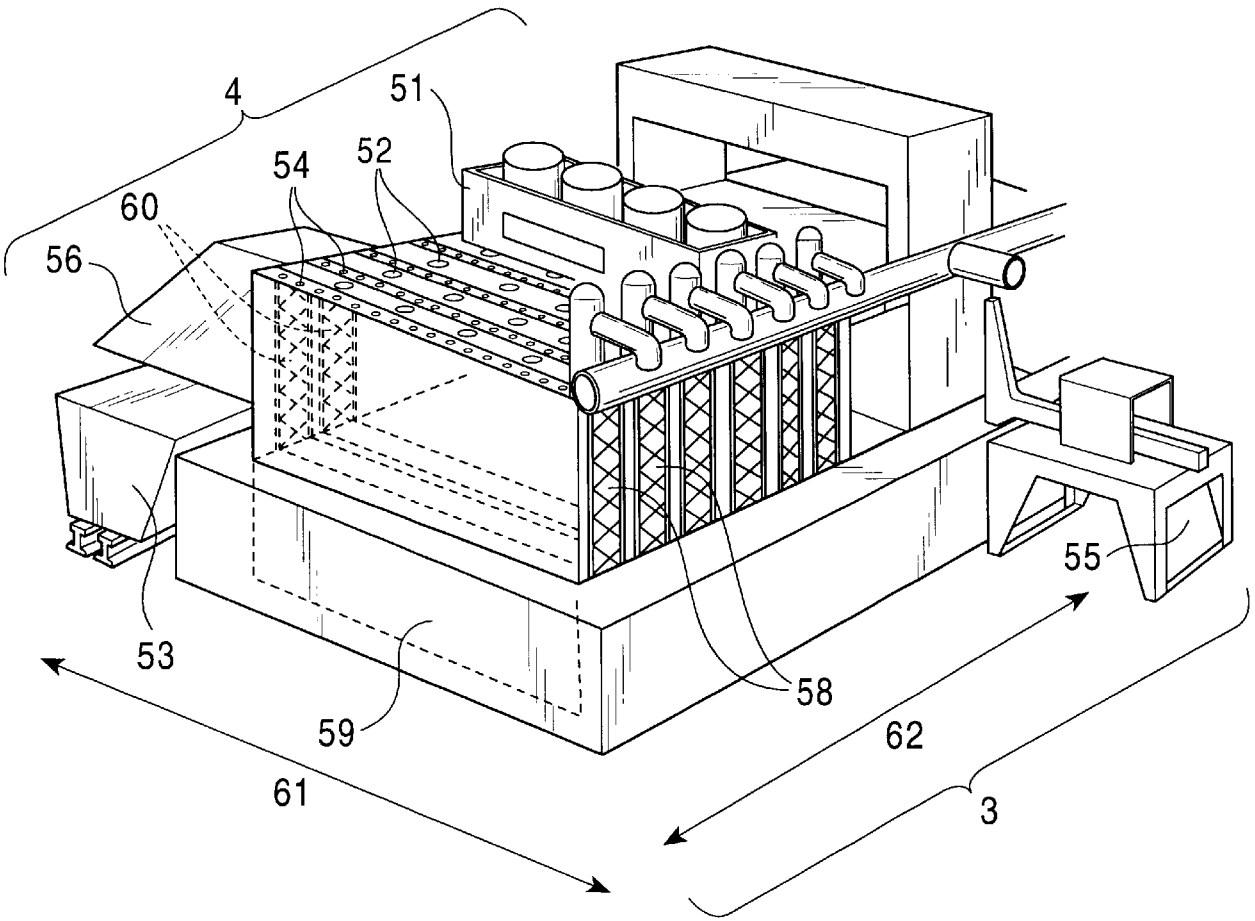
FIG. 1 is a perspective view of a coke oven.
Figure 2:
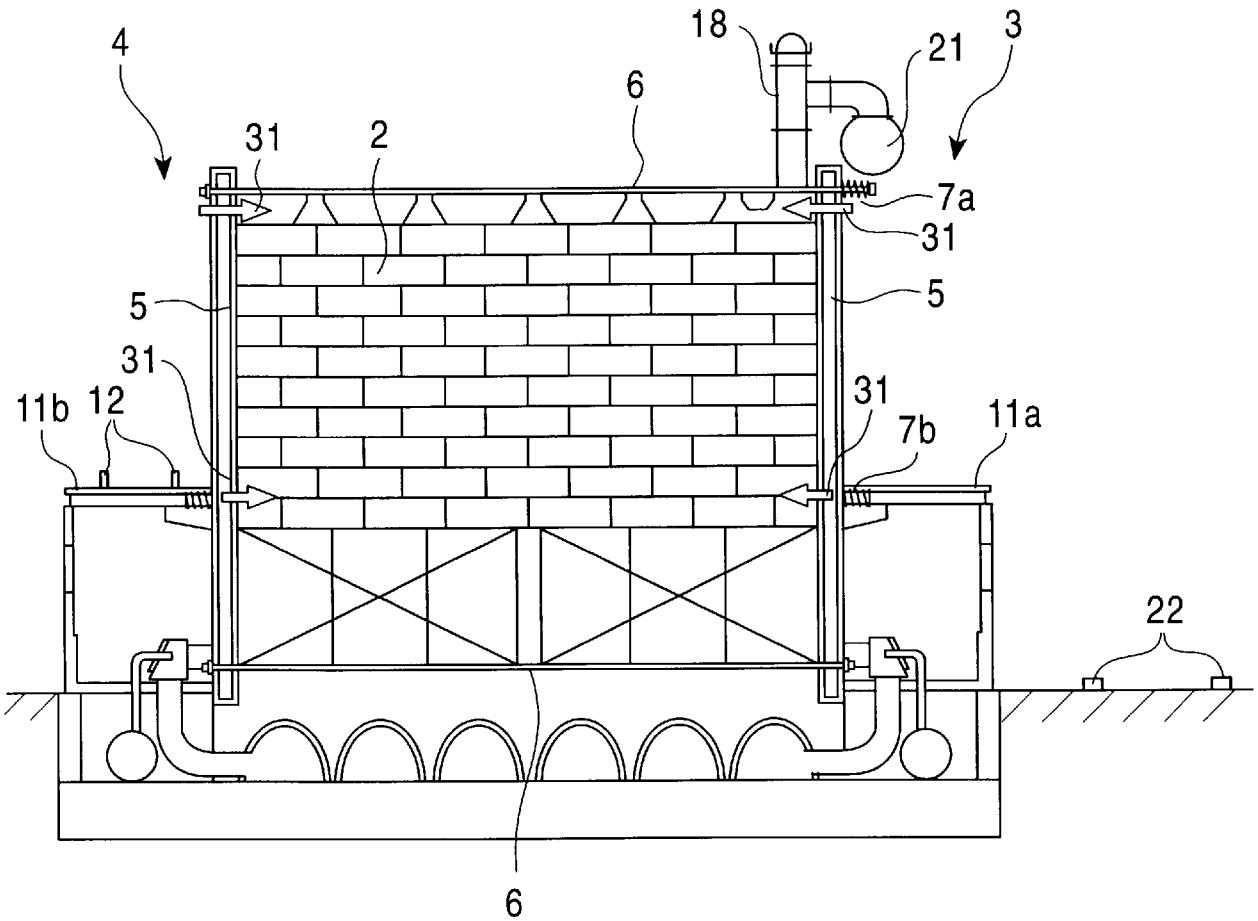
FIG. 2 is a sectional view of a carbonization chamber of the coke oven viewed perpendicularly to the lengthwise direction thereof.
Figure 3:
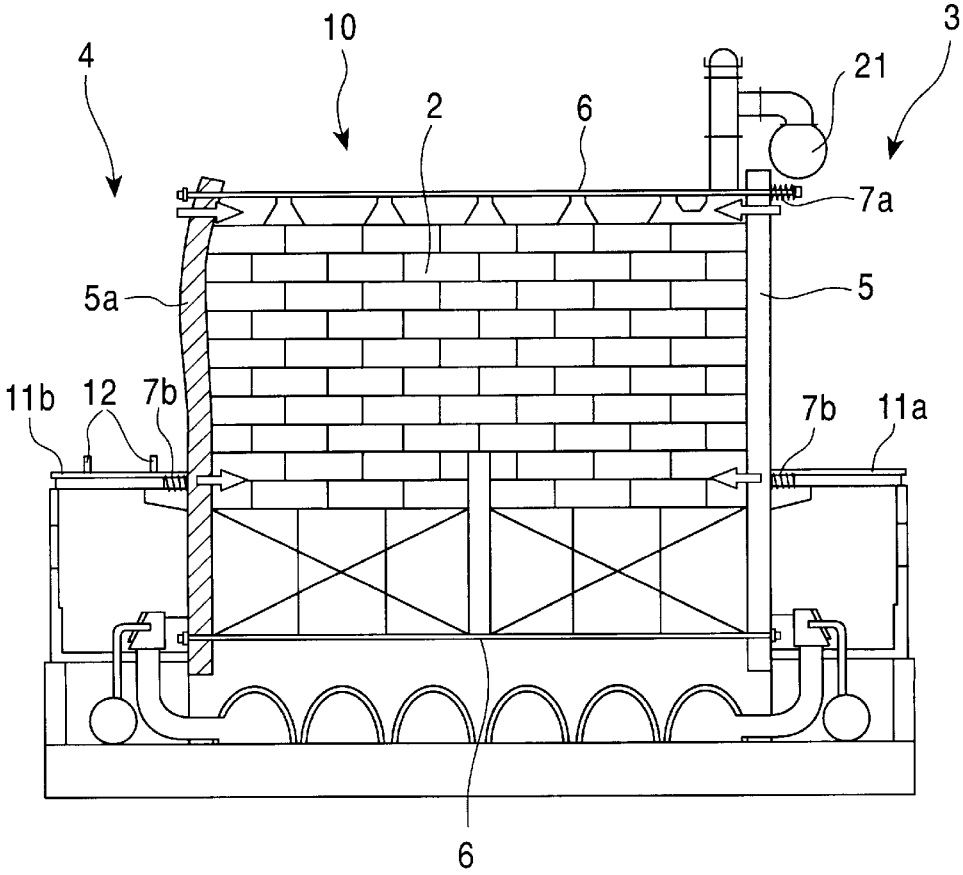
FIG. 3 is a sectional view of a carbonization chamber of the coke oven at which a deformed buckstay is located viewed perpendicularly to the lengthwise direction of the coke oven.
Figure 4A:
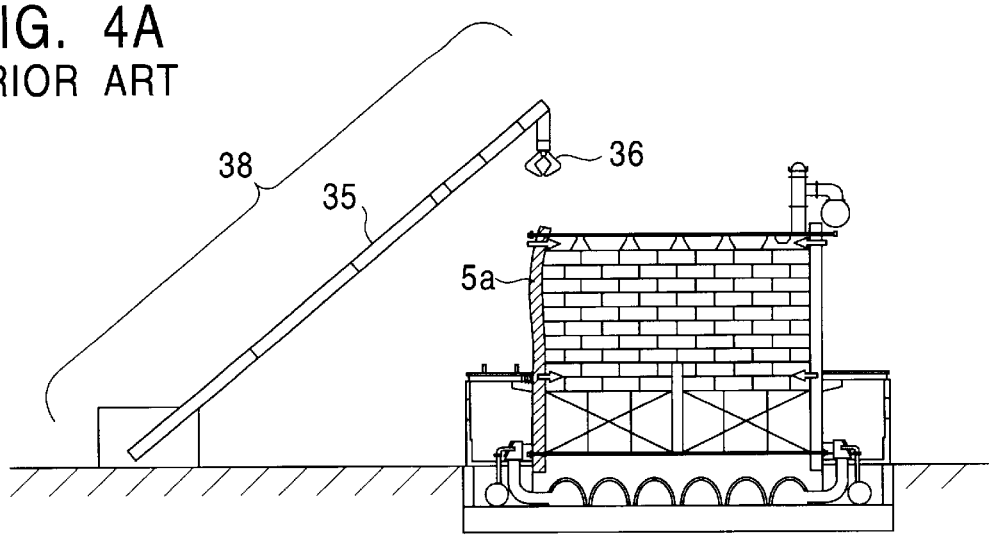
FIG. 4A PRIOR ART
FIGS. 4A to 4C illustrate a conventional method of removing a buckstay.
Figure 4B:
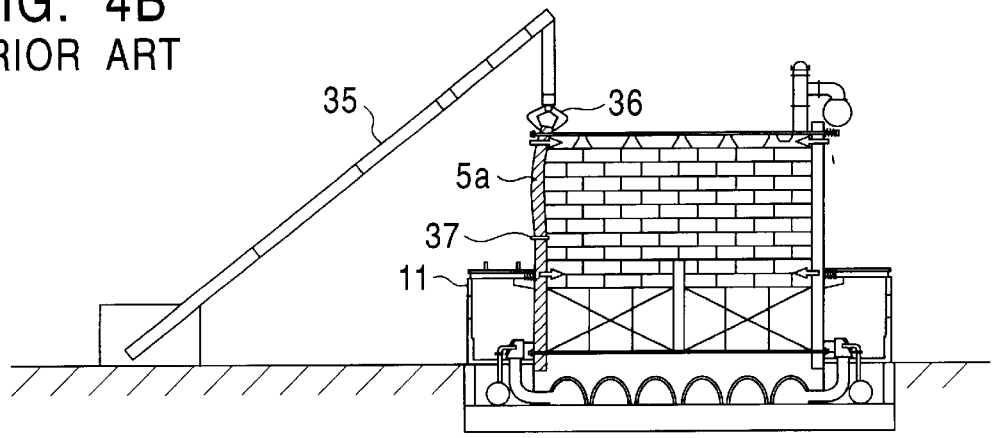
FIG. 4B PRIOR ART
Figure 4C:
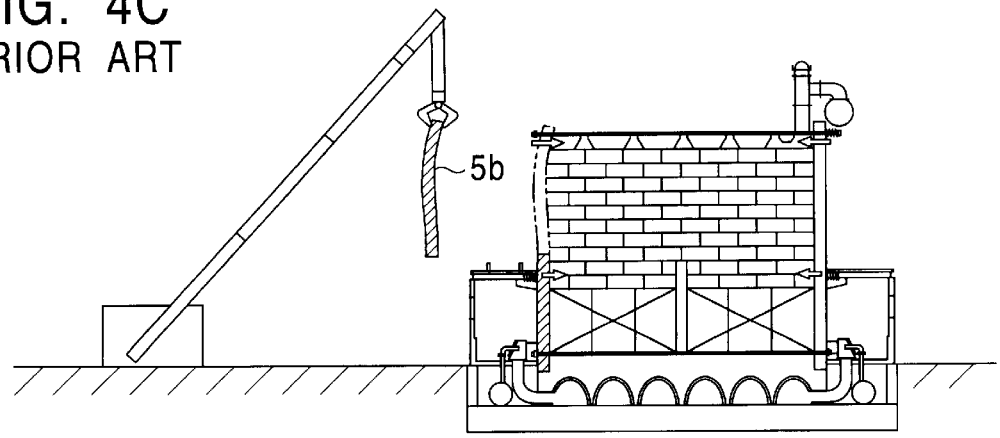
FIG. 4C PRIOR ART
Figure 5B:
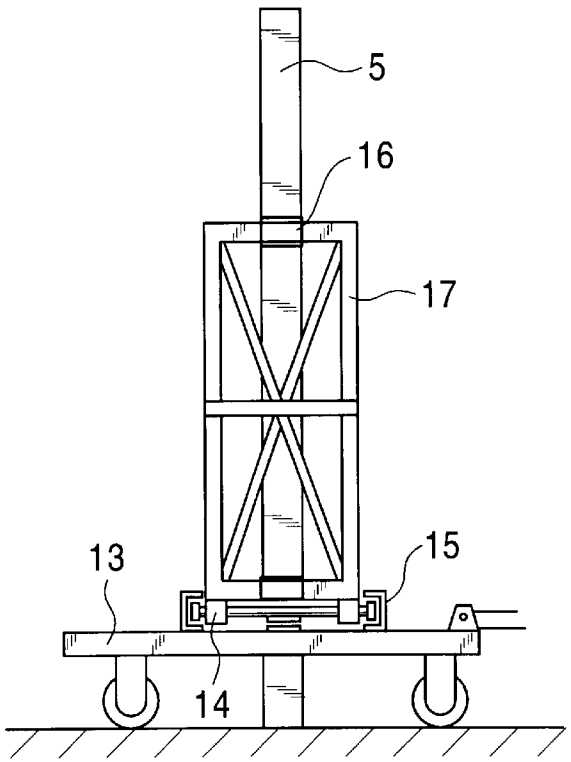
FIG. 5B is a side view a condition in which a buckstay is set onto a buckstay moving device in accordance with the present invention.
Figure 5A:
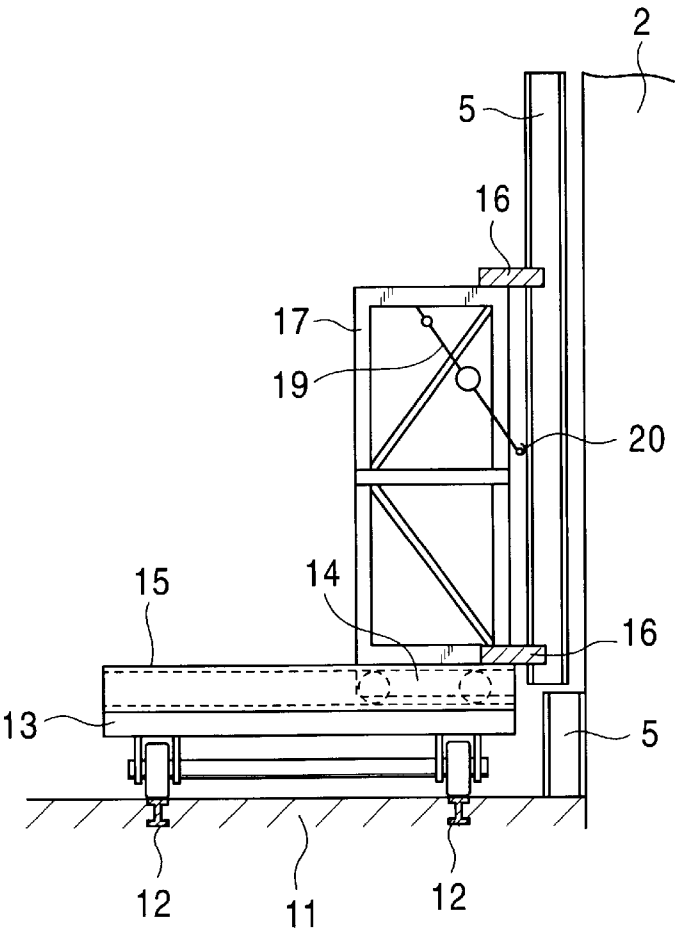
FIG. 5A is a front view of a condition in which a buckstay is set onto a buckstay moving device in accordance with the present invention.

FIGS. 5A and 5B illustrate an embodiment of the buckstay moving device (hereinafter simply referred to as "moving device") in accordance with the present invention. As shown in FIG. 5A, the buckstay moving device primarily comprises a main car 13 that can move on a machine side (M/S) platform 11*b* or a coke side (C/S) platform 11*a*; and a subcar 14 placed on the main car 13. The main car 13 may be an automatically movable car, or may be made movable by a driving means such as a forklift. Here, as shown in FIG. 5A, at the C/S, the main car 13 can move on rails 12 along which the guide car 56 moves, and the guide car may be used as a driving means. The main car 13 can move quickly in the widthwise direction 62 to the front of any of the combustion chambers 54 and thus to the location of a buckstay 5 (provided in a vertically standing manner) that needs to be repaired.

On the main car 13 is placed the subcar 14 which is movable in the forward and backward directions in longitudinal directions 61 of a coke oven. Securing means 16 for holding the buckstay 5 are provided at the subcar 14. Usable means for moving the subcar 14 forward or backward include rails separately provided on the main car 13, or a guide groove 15 for accepting wheels or other guide members provided on the subcar 14 shown in FIG. 5A.

The securing means 16 for holding either the buckstay to be removed or the replacement buckstay depending upon the stage of repair and replacement can quickly and easily move to a location very near the buckstay 5 (that needs to be subjected to replacement and repair) or to a location where they can come into contact with it, making it possible to quickly replace a portion of the buckstay 5. As shown in FIG. 5B, the securing means 16 can be affixed to portions of a frame 17 provided on the subcar 14. Although, in FIG. 5A, the two securing means are mounted to the top and the bottom ends of the frame 17, the number and location of usable securing means are not particularly limited in the present invention. The portion of the buckstay S that needs to be repaired can be solidly secured by various conventional methods and means. For example, when the buckstay 5 is formed of an H-type or an I-type steel, a method of securing the buckstay 5 with a bolt after grasping a flange thereof can be used. In addition, a means for grasping and securing the steel pillered member making up the buckstay 5 from the left and right sides thereof can also be used. In addition to these securing means and method, as shown in FIG. 5A there can also be used a method of suspending the buckstay 5 by connecting a chain block 19, mounted to the frame 17, to a suspension piece 20.

Compared to the case where repairing is carried out with the conventional crane, the time required to secure a buckstay is considerably reduced when repairing is carried out with the repairing device of the present invention.

After the securing operation, the deformed portion 5*a* of the buckstay 5 is cut off and taken out from between the tension rods 6. The subcar 14 and the main car 13 then are moved away from the coke oven. As shown in FIG. 5C, only the portion 5*c* that has been cut off is grasped by the securing means 16 and quickly removed from the place where the cutting operation has been carried out. Cutting methods include mechanical cutting and the conventional method of manual melting with gas.

Figure 5D:
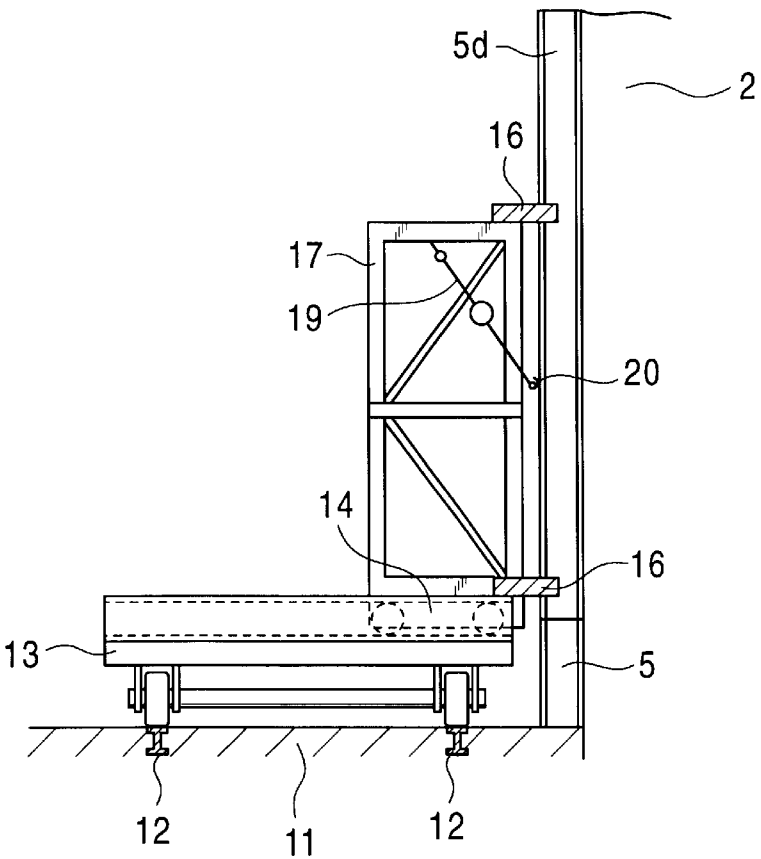
FIG. 5D is a front view of a buckstay in which new buckstay portion is welded in accordance with the present invention.
Figure 5C:
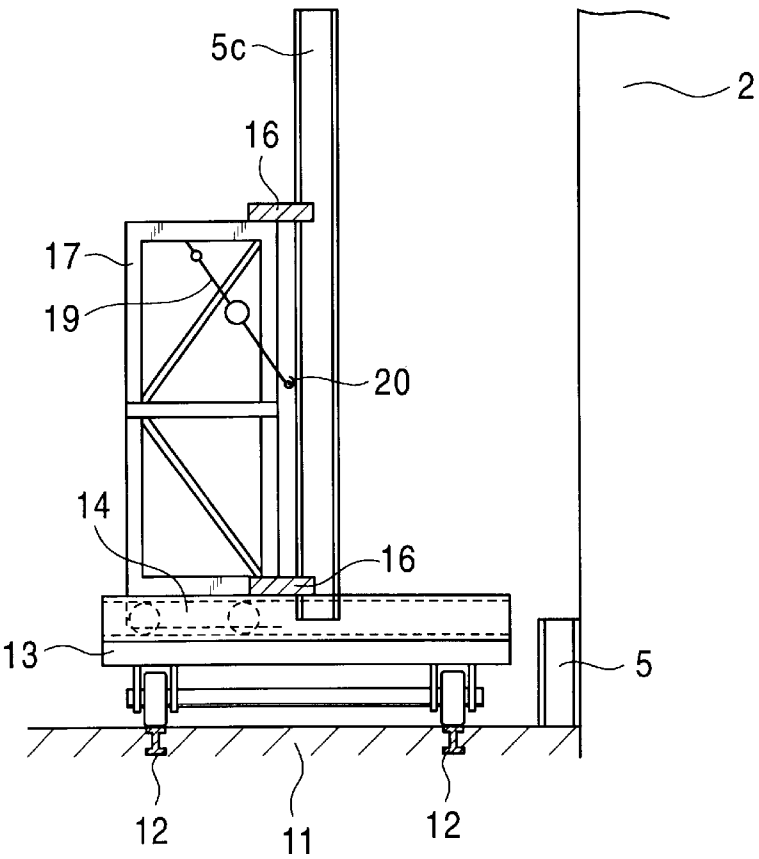
FIG. 5C is a front view of a buckstay removed from its original position on the coke side in accordance with the present invention.

A replacement buckstay member can be smoothly and easily mounted into the area of the coke oven where the cutting operation has been performed and the defective portion 5*c* of the buckstay has been removed by moving the subcar and the main car while the replacement buckstay member 5*d* is grasped by the securing means 16, placing the replacement buckstay member between the tension rods 6, and placing it onto the remaining portion of the original buckstay 5 of the coke oven where the cutting operation has been performed, joining the replacement buckstay thereto, as shown in FIG. 5D. The joining operation can be easily achieved by a manual welding operation.

EXAMPLE 1

Existing buckstays (ten in all) of the chamber-oven-type coke oven having 72 carbonization chambers were removed, and replacement buckstay members were mounted and installed after repairing the bricks of the oven walls. The coke oven is 15 meters long in a longitudinal direction of the carbonization chambers and is 6 meters high.

Buckstay repairing operations were carried out using the conventional crane method and the method of the present invention using the desired moving device. The results of comparison of the two methods are summarized in Table 1.

TABLE 1

| | Average removal time (hrs) | Average mounting time (hrs) | Number of workers |
|---|---|---|---|
| Present invention | 3 | 3 | 6 |
| Conventional example | 8 | 8 | 10 |

From Table 1, it is obvious that when the moving device of the present invention is used, the buckstays can be removed and replacement buckstay members can be mounted in a much shorter time than when the conventional method is used. In addition, fewer workers are required. In other words, the use of the moving device of the present invention saves labor in the form of both time and manpower, and allows operations to be carried out more safely. Therefore, the moving device of the present invention contributes to the reduction of time required to repair coke ovens, and helps to limit the reduction of coke production during reparation operations and helps increase the usable life of the coke oven.

Figure 6:
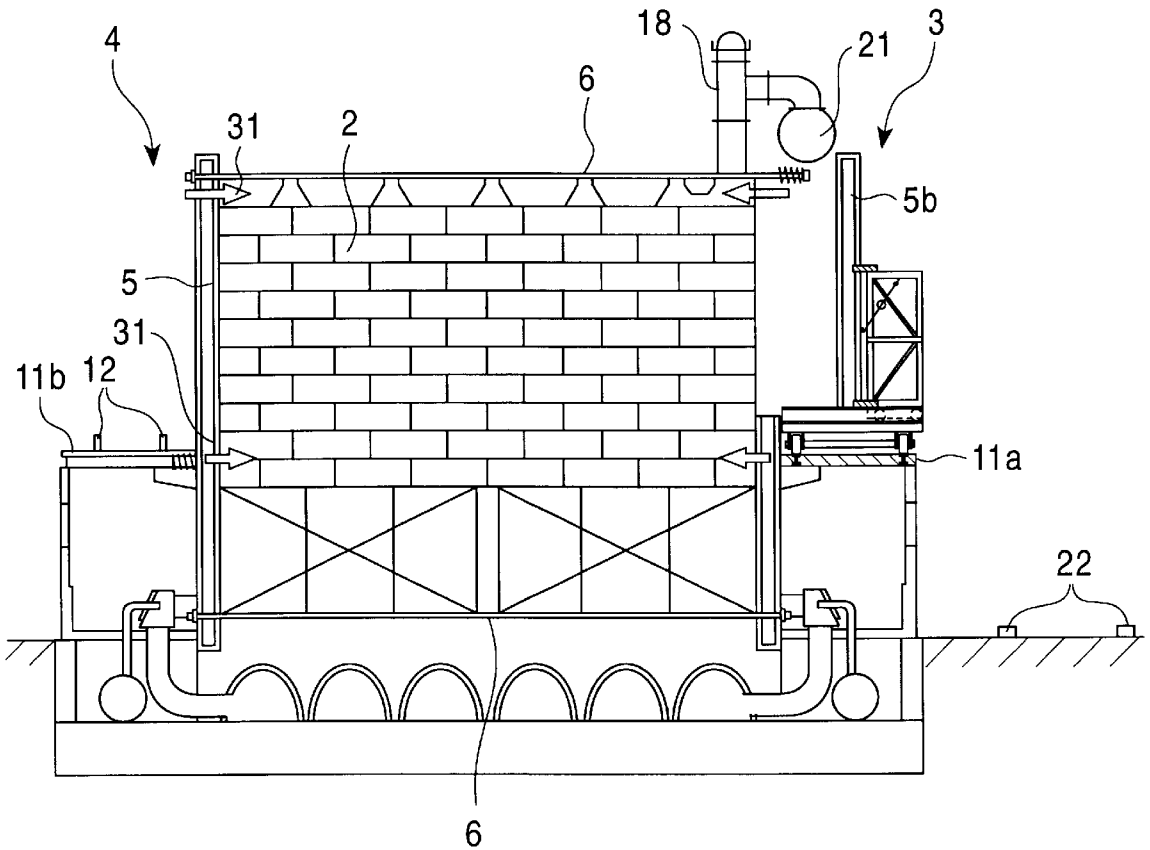
FIG. 6 is a front view of a buckstay removed from its original position on the machine side in accordance with the present invention illustrate a inventiois.

In the above-described embodiment, the repairing of the C/S buckstay of the oven was described. As shown in FIG. 6, the present invention may also be applied to the repairing of the M/S buckstay which cannot be repaired using the conventional method because of the aforementioned problems associated with the use of the crane.

As can be understood from the foregoing description, according to the present invention, buckstays can be reliably and smoothly secured, even in the case where a crane cannot be disposed when the buckstays are to be repaired. As a result, defective portions of the buckstays can be easily and quickly removed. Then, they can be replaced with replacement buckstay members in order to repair the buckstays of the coke oven.

What is claimed is:

1. A coke oven buckstay moving device for removing and replacing a defective portion of the buckstay, which supports a wall of the coke oven, with a new member, said moving device comprising:

a main car which moves on a side platform of the coke oven;

a subcar placed on the main car, freely movable forward and backward in a lengthwise direction of the coke oven; and securing means, mounted to the subcar, for securing the defective portion or the new member of the buckstay.

2. The moving device of claim 1, wherein said subcar further comprises a frame mounted on said subcar for movement therewith, wherein said securing means are affixed to said frame.

3. The moving device of claim 2, wherein said securing means comprises a grasping bolt for engaging said buckstay.

4. The moving device of claim 2, wherein said securing means comprises:

a chain block, mounted to said frame; and a suspension piece for engaging and holding the buckstay.

5. The moving device of claim 1, wherein said main car is movable on a set of guide rails provided on the side platform.

6. The moving device of claim 1, wherein said side platform is a coke side platform.

7. The moving device of claim 1, wherein said side platform is a machine side platform.

8. A method for repairing a coke oven buckstay by replacing a defective portion of the coke oven buckstay with a new member, comprising the steps of:

moving a main car that moves on a side platform to a front side of the buckstay that needs to be repaired, forwardly moving a subcar disposed on the main car to a location near the buckstay that needs to be repaired, securing the defective portion of the buckstay that needs to be repaired to the subcar via securing means, cutting off and removing the secured defective portion of the buckstay, mounting a replacement buckstay member to the securing means mounted to the subcar, moving the main car to the front side of the buckstay that needs to be repaired, forwardly moving the subcar to position said replacement member, mounting and welding the replacement member to the remaining portion of the buckstay of the previous location of the removed defective portion.

9. The method of claim 8, wherein said cutting and removing step further comprises the steps of:

cutting said secured defective portion at a location proximate said platform;

moving said subcar backwardly, away from said coke oven to facilitate removal of said cut and secured defective portion; and unsecuring and removing said cut and secured buckstay from said subcar.

10. The method of claim 8, wherein said side platform is a coke side platform.

11. The method of claim 8, wherein said side platform is a machine side platform.

* * * * *

UNITED STATES PATENT AND TRADEMARK OFFICE

CERTIFICATE OF CORRECTION

PATENT NO. : 6,733,635 B1
DATED : May 11, 2004
INVENTOR(S) : Ozawa et al

It is certified that error appears in the above-identified patent and that said Letters Patent is hereby corrected as shown below:

Title page,
Item [75], Inventors, please add -- Syougo Yokemura, Chiba Japan --.

Column 4,
Line 61, please change “buckstay S” to -- buckstay 5 --.

Signed and Sealed this

Twenty-eighth Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,733,635 B1
DATED : May 11, 2004
INVENTOR(S) : Ozawa et al.

It is certified that error appears in the above-identified patent and that said Letters Patent is hereby corrected as shown below:

Title page,
Item [73], Assignee, please add the following:
-- Otto Corporation --.

Signed and Sealed this

Ninth Day of November, 2004

JON W. DUDAS
*Director of the United States Patent and Trademark Office*